United States Patent [19]

Scales

[11] Patent Number: 4,865,481

[45] Date of Patent: Sep. 12, 1989

[54] DISPOSABLE TOOTHBRUSH WITH TOOTHPASTE, MOUTHWASH AND FLOSS

[76] Inventor: Joseph K. Scales, 212 Dewey Ct., Claymont, Del. 19703

[21] Appl. No.: 190,077

[22] Filed: May 4, 1988

[51] Int. Cl.[4] ..... A46B 11/02

[52] U.S. Cl. ..... 401/195; 132/308; 132/309; 401/132; 401/268; 401/123

[58] Field of Search ..... 401/268, 132, 123, 124, 401/125, 195; 132/308, 309, 311

[56] References Cited

U.S. PATENT DOCUMENTS

| | | | |
|---|---|---|---|
| 1,582,589 | 4/1926 | Exline | 401/268 X |
| 1,811,833 | 6/1931 | Simon | 401/132 |
| 2,468,732 | 5/1949 | Boulicault | 401/268 X |
| 3,316,580 | 5/1967 | Tebbs | 401/132 |
| 3,356,095 | 12/1967 | Tylle | 401/132 X |
| 3,432,245 | 3/1969 | Hudson | 401/132 |

FOREIGN PATENT DOCUMENTS

| | | | |
|---|---|---|---|
| 602556 | 8/1960 | Canada | 401/123 |
| 1201779 | 7/1959 | France | 401/123 |
| 2480099 | 4/1980 | France | 401/268 |
| 4200 | of 1881 | United Kingdom | 401/291 |

*Primary Examiner*—Steven A. Bratlie

*Attorney, Agent, or Firm*—Richard C. Litman

[57] ABSTRACT

A disposable toothbrush having a quantity of self-contained dentrifice, mouthwash, and dental floss. The dentrifice is contained in a pliable receptacle, which communicates with a hollow passage located in the bristle end of the toothbrush, the hollow passage including a plurality of orifices terminating at the bed of the bristles, whereby upon squeezing the pliable receptacle, the dentrifice is distributed through the hollow passage and into the bed of the toothbrushing bristles. The self-contained mouthwash container is affixed adjacent the handle portion of the apparatus, whereby upon compressing the pliable container, the mouthwash can be utilized. When removed from the main body of the toothbrush the mouthwash may be used and discarded after same. The dental floss is stored within a compartment along the upper portion of the main body of the toothbrush and may be readily removed for use and also discarded after same.

4 Claims, 1 Drawing Sheet

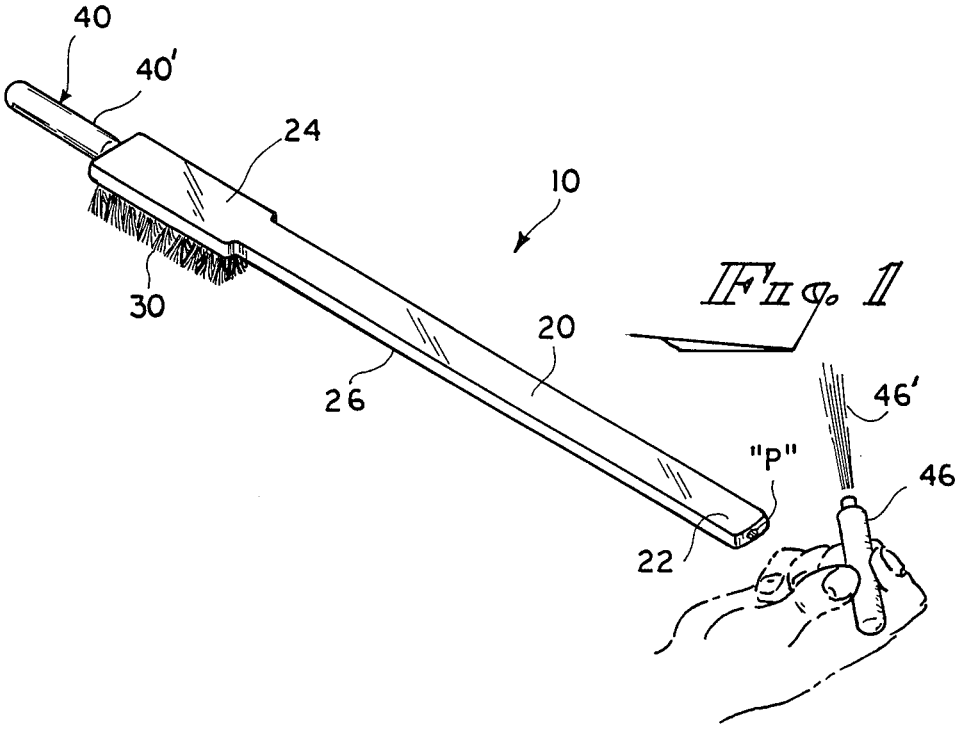
Fig. 1
Fig. 2
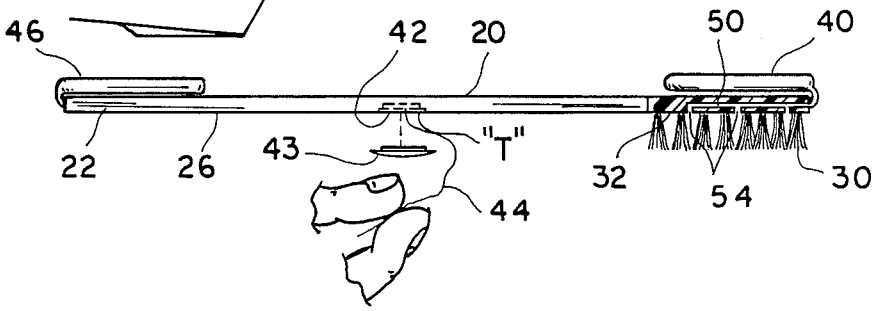
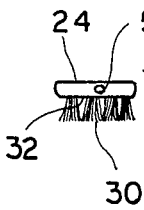
Fig. 3
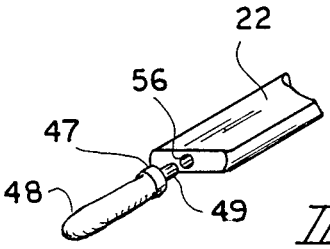
Fig. 4

DISPOSABLE TOOTHBRUSH WITH TOOTHPASTE, MOUTHWASH AND FLOSS

BACKGROUND OF THE INVENTION

1. FIELD OF THE INVENTION

The invention relates to toothbrushes and more particularly to disposable toothbrushes wherein a given quantity of toothpaste is provided along with a predetermined supply of mouthwash and dental floss.

It is well known that in today's society proper dental care is often times neglected due to time restraints during meals either at work, school, or during recreational activites. The burden of carrying one's toothpaste and other hygienic dental paraphernalia to work, or otherwise away from home, also contributes to the problem of neglect.

It is also well known that without proper dental hygiene, one risks contracting gum disease and a number of toerh ailments relating to oral hygiene.

Therefore, the invention further relates to an improved disposable toothbrush which provides for complete dental hygienic care in a unitary unit, wherein the invention includes a self-contained quantity of dentrifice, mouthwash, and dental floss. In this arrangement a disposable dental hygiene utensil is provided which is completely transportable, unitary in consturction, and allows proper dental hygienic care for those who may otherwise neglect their very important oral hygienic duties.

The method of consturction of the invention ismore fully described herein.

2. DESCRIPTION OF THE PRIOR ART

Various prior art disposable toothbrush apparatus and the like, as well as the method of their construction in general, are known and are found to be exemplary of the U.S. prior art. They are:

| U.S. Pat. No. | Inventor |
|---|---|
| 3,165,776 | Tuseth |
| 4,503,871 | Mendenhall |
| 4,522,524 | Green |
| 4,530,129 | Labick, et al. |
| 4,588,089 | Yanz, Jr. et al. |

The Labick et al. patent is an assembly which includes a wrapper containing a toothbrush, a small amount of toothpaste, and short length of rolled up dental floss.

The Green patent is an integrated dentrifice and brushing container wherein an enlarged dentrifice chamber is shown having a passage extending between the dentrifice chamber and the bristle portion of the toothbrush, thereby providing means for displacing the dentrifice from the enlarged chamber to the bristles of the toothbrush.

The Mendenhall patent discloses pre-packaged dentrifice containers which are received in holding compartments located within the handle portion of the apparatus. The dentrifice containers have peel-off covers and are severable from each other and the container to permit individual removal thereof.

These patents, or known prior uses, teach and disclose various types of disposable toothbrushes, as well as methods of their construction; but none of them, whether taken signly or in combination, disclose the specific details of the combination of the invention as to bear upon the claims of the present invention.

SUMMARY OF THE INVENTION

An object, advantage, and feature of the present invention is to provide a novel disposable toothbrush that is efficient in use and inexpensive in its manufacture, providing its user with a low cost disposable toothbrush having an integral or self-contained supply of dentrifice, readily accessible and practically disposable upon dentrifice depletion.

Another object of the present invention is to provide a disposable toothbrush integral with paste or liquid dentrifice supply which is readily accessible upon compression of a pliable dentrifice container and practically disposable upon depletionof same.

A further objectof the present invention is to provide a disposable toothbrush integral with liquid mouthwash supply which is readily accessible upon compression of pliable liquid mouthwash container.

It isstill a further object of the present invention to provide a disposable toothbrush having a self-contained supply of dental floss selectivley accessible upon removal of a protective cap and discarded after usage.

Furthermore, it is still another object of the present invention to provide a disposable toothbrush which is easily transportable wherein the disposable toothbrush may be discreetly and comfortably carried to work, school, or to recreational areas, e.g., sporting events, camping, etc., in the user's pocket or purse.

With these and other objects in view which will more readily appear as the nature of the invention is better understood, the invention consists in the novel construction, combination and arrangements or parts hereinafter more fully described, illustrated and claimed, with reference being made to the appended drawing.

DESCRIPTION OF THE SEVERAL VIEWS OF THE DRAWINGS

FIG. 1 is a perspective view of the device illustrating compression of the pliable liquid mouthwash container and further illustrating a typical construction of the device according to a preferred embodiment and best mode of the present invention.

FIG. 2 is a side elevational view of the integrated dentrifice and dentrifice passage channels, with portions cut away, illustrating details of the dentrifice passage channels. Further illustrated is the dental floss compartment recess providing for a thumb rest for the user upon removal of the protective cap of FIG. 1 and removal of the self-contained dental floss contained therein.

FIG. 3 is a front end view of the bristle portion of the present invention, having the pliable paste dentrifice container removed, thereby illustrating the inlet port of same.

FIG. 4 is a fragmentary view of the of an alternate embodiment of the handle portion of the invention illustrating a detachably affixed pliable liquid mouthwash container.

DESCRIPTION OF THE PREFERRED EMBODIMENT OF THE INVENTION

Referring now to the drawings, there is shown in FIG. 1 the disposable toothbrush, hereinafter referred to as the device 10, comprises a rigid elongated member 20, which includes a handle end 22 and a bristle end 24. Deployed between the handle end 22 and the bristle end 24, is dental floss storage compartment 42 defining a recess written elongated member 20. Dental floss 44 is readily accessible upon removal of the dental floss compartment lid or cap 43 providing for manual extraction of the dental floss 44 from its compartment 42, prior to usage thereof. Upon usage of a single supply of coiled dental floss 44, the user may discard same. Attached laterally along opposite side 25 of side 26' of bristle end 24 is pliable dentrifice dispenser 40, having a single supply of liquid or paste dentrifice. Also shown is pliable mouthwash container 46 attached to a terminal section of the handle end 22 having a single supply of oral rinse or mouthwash. FIG. 1 further illustrates the release or discharge of the liquid mouthwash 46' from its pliable container 46 upon removal at point "P".

As shown in FIGS. 2 and 3, passage conduit 50 is longitudinally disposed within the bristle end 24 of the device 10. Conduit 50 extends longitudinally to ilnet port 52, which is disposed at a distal surface 23 of bristle end 24. A flexible passageway 53 communicatively connects with inlet 52 and pliable dentrifice dispenser 40. A plurality of orifices 54 are vertically disposed from bristle end 24 and openly communicate with conduit 50 and side 26'. A plurality of bristles 30 has one of their respective ends secured laterally along side 26' and their respective other ends project substantially perpendicular with respect thereto. Orifices 54 are equidistantly spaced parallel along conduit 50. Upon compression of pliable dentrifice dispenser 40 the single supply of dentrifice, preferably in paste form, is displaced through flexible passageway 53, thorugh conduit 50 and orifices 54, deposited alterally along side 26' and evenly distributed amongst the plurality of bristles. In this manner the disposable toothbrush 10 provides for a truly transportable dental hygiene unit or tool.

Removal or protective cap 43 and dental floss 44 from dental floss compartment 42 provides a thumb rest "T" for the user during toothbrushing. Pliable mouthwash container 46 is positioned at the terminal section of handle end 22 and has an end detachably affixed to receptor 25 which is disposed at distal surface 23, as seen in FIG. 4. Alternately, mouthwash container 46 may be folded laterally along either side of handle end 22 as shown in FIG. 2. As best shown in FIG. 4, preferably, mouthwash container 46 includes a sheath 47 having a flexible projecting connector 49 at an end thereof and when removed from receptor 25 displays an orifice (not shown). Upon detachment of said second plaible mouthwash container 48 and compression of same, said mouthwash may be used and the pliable mouthwash container 48 may be readily discarded upon depletion of the enclosed mouthwash.

The foregoing is considered as illustrative only of the principles of the invention. further, since numerous modifications and changes will readily occur to those skilled in the art, it is not desired to limit the invention to the exact construction and operation shown and described, and accordingly, all suitable modifications, and equivalents which may be resorted to, will be understood to fall within the scope of the invention.

What is claimed is:

1. A combination disposable toothbrush including a dentrifice dispenser, a mouthwash container, and a dental floss compartment comprising:

a rigid elongated member having opposite ends consisting of a handle end and a bristle end;

a plurality of bristles having one of their respective ends secured laterally along a first side of said bristle end and their respective other ends projecting substantially perpendicular with respect thereto;

said bristle end having a conduit longitudinally disposed thereinand a plurality of orifices vertically disposed therefrom, said plurality of orifices opening inot said conduit and openly communicating with said first side of the bristle end, said conduit also extending longitudinally to an inlet port perpendicularly dispsoed therefrom at a distal surface of said bristle end;

a pliable dentrifice dispenser containing a single supply of dentrifice positioned laterally along an opposing side of said first side of the bristle end, said dentrifice dispenser communicatively connects with said inlet port by a flexible passageway, whereby upon compression of said pliable dentrifice dispenser the single supply of dentrifice is displaced through said flexible passageway, through said conduit and plurality of orifices and deposited laterally along said first side of the bristle end for subsequent toothbrushing;

a pliable mouthwash container positioned at a terminal section of said handle end containing a single supply of oral rinse having an end detachably affixed to a receptor disposed at a distal surface of said handle end; and a dental floss compartment containing a single supply of coiled dental floss, recessed within said rigid elongated member proximally between said handle end and said bristle end.

2. The combination disposable toothbrush according to claim 1, wherein said plurality of orifices are equidistantly spaced parallel along said conduit, whereby upon compression of said pliable dentrifice dispenser, the supply of dentrifice in the form of a paste is evenly distributed amongst the plurality of bristles.

3. The combination disposable toothbrush according to claim 1, wherein said pliable mouthwash container upon removal from the receptor displays an orifice at said end detachably affixed to said receptor through which the single supply of oral rinse is dispensed for use by compression.

4. The combination disposable toothbrush according to claim 1, wherein said dental floss compartment is provided with a removable cap.

* * * * *